United States Patent [19]

Akahane

[11] 4,396,297

[45] Aug. 2, 1983

[54] DEVICE FOR STOPPING THE STRIKING OF A CLOCK AT NIGHT

[75] Inventor: Masahiro Akahane, Nagano, Japan

[73] Assignee: Rhythm Watch Co., Ltd., Tokyo, Japan

[21] Appl. No.: 351,438

[22] Filed: Feb. 23, 1982

[30] Foreign Application Priority Data

| | | | |
|---|---|---|---|
| Feb. 27, 1981 | [JP] | Japan | 56-28114 |
| Apr. 30, 1981 | [JP] | Japan | 56-63463[U] |
| Nov. 7, 1981 | [JP] | Japan | 56-179203 |

[51] Int. Cl.[3] ..... G04B 23/00

[52] U.S. Cl. ..... 368/262; 368/272; 368/273; 368/252

[58] Field of Search ..... 368/262, 272, 273, 252, 368/250; 200/267, 38 C, 38 DB, 37 R, 35 R; 29/622

[56] References Cited

U.S. PATENT DOCUMENTS

| | | | |
|---|---|---|---|
| 699,303 | 5/1902 | Fox | 368/273 |
| 1,304,924 | 5/1919 | Wehinger | 368/273 |
| 1,322,216 | 11/1919 | Adams et al. | 368/273 X |
| 2,281,888 | 5/1942 | Snyder | 200/37 R |
| 2,817,401 | 12/1957 | Ostrander | 200/38 DA |
| 3,293,399 | 12/1966 | Heinrich | 200/267 X |
| 3,396,457 | 8/1968 | Nordin | 29/622 |
| 3,500,290 | 3/1970 | Hall et al. | 29/622 |
| 3,819,886 | 6/1974 | Homan et al. | 200/36 X |
| 4,209,968 | 7/1980 | Remys et al. | 368/262 |

*Primary Examiner*—Ulysses Weldon

*Attorney, Agent, or Firm*—Koda and Androlia

[57] ABSTRACT

A device for stopping the striking of a time-striking clock at night which includes a striking stop contact driven by a clock gear train through the agency of an associated intermittent gear train. The intermittent movement of the striking stop contact is controlled in connection with the preselected times at which the strikings are to be made, so that the stopping and resumption of the striking may be selected not to fall on the preselected times, thus assuring a reliable operation of stopping the striking at a desired time.

8 Claims, 6 Drawing Figures

DEVICE FOR STOPPING THE STRIKING OF A CLOCK AT NIGHT

This invention relates to a device for stopping the striking of a time-striking clock at night, and more specifically to an improvement of a device for stopping the striking of a time-striking clock at night which is capable of preventing the clock from striking between desired times, said device comprising a striking stop contact electrically connected with an associated time-striking circuit and operatively connected to an associated clock gear train.

As is well known, a time-striking clock strikes or chimes at every hour, and the striking or chiming often disturbs persons in their sleep. Therefore, there has been a demand for preventing the clock from striking at night.

A conventional device for stopping the striking of a time-striking clock at night comprises a striking stop contact included in circuit with an associated time-striking circuit and operatively connected to an associated clock gear train, thereby controlling the opening-and-closing of the striking stop contact so as to prevent the clock from striking between desired times at night. Thus, the disturbance of sleep can be eliminated, and electric power which otherwise, would be consumed by the striking is saved accordingly.

In such a conventional device for stopping the striking of a time-striking clock at night, a striking stop contact is provided on a gear wheel which is adapted to continuously rotate with the clock gear train, and this is a cause for unreliable operation, as for instance the striking stops or resumes behind or ahead of the desired time, and the preset length of time between desired times varies accordingly. In particular, a Westminster clock strikes every fifteen minutes, and in this kind of clock sometimes the striking does not stop or resume exactly at a desired time if the stopping or resumption of the striking is desired at a given time within the fifteen minutes between successive strikings. Thus it is that unreliable operation results particularly in the Westminster clock. In a conventional device for stopping the striking of a time-striking clock at night the striking stop contact is put in a sliding contact relationship with an associated stationary contact at all times, and sometimes a poor electrical contact results, causing unstable control of striking.

In view of the above the object of this invention is to provide an improved device for stopping the striking of a time-striking clock at night which permits accurate stopping and resumption of the striking at desired times.

This invention relates to an improvement of a device for stopping the striking of a time-striking clock at night in which device a striking stop contact is included in circuit with an associated time-striking circuit and is operatively connected to a clock gear train of the clock for controlling the opening-and-closing of the striking stop contact in such a way that the striking is made to cease from a desired time on, and according to this invention the striking stop contact is so constructed that it is rotated in a sliding-contact relationship with the associated stationary contact by the clock gear train through the agency of an intermittent drive gear train in such a way that the sliding of the rotary contact on the underlying stationary contact follows the movement of the clock gear train, and hence the rotation of the rotary contact is performed during the closing of a minute hand control contact, which is used for setting a desired time for resuming the striking, that is, between the termination of the striking as desired and the resumption of the striking as desired.

The object of this invention will be understood from the following description of preferred embodiments which are shown in the accompanying drawings.

Figure 1:
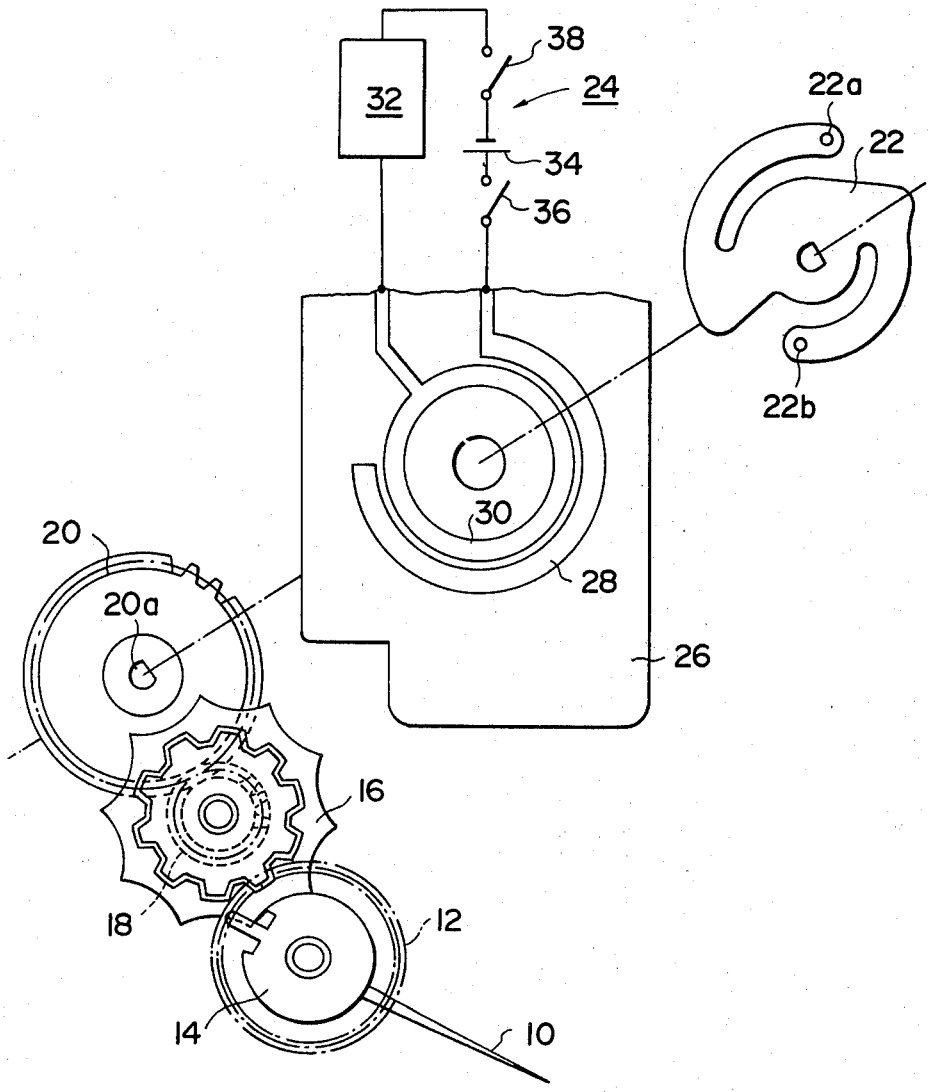
FIG. 1 shows a first embodiment according to this invention.

Referring to FIG. 1, a minute hand 10 is fixed to a minute hand wheel 12, which constitutes a part of a clock gear train driven by a stepping motor and other driving means (not shown), and which is used for indicating a desired time.

According to this invention an intermittent gear train is operatively connected to the clock gear train. In this particular embodiment the minute hand wheel 12 drives the intermittent gear train, which includes a Geneva drive. As shown in FIG. 1, a Geneva drive wheel 14 is fixed to the minute hand wheel 12, and an associated Geneva driven wheel 16 engages with the Geneva drive wheel 14. The minute hand wheel 12 rotates one revolution in sixty minutes, and one revolution of the minute hand wheel 12 causes the Geneva driven wheel 16 to rotate one pitch. In this particular embodiment the Geneva driven wheel 16 advances one pitch in five minutes. A pinion gear 18 is fixed to the Geneva driven wheel 16, and the pinion gear 18 engages with an electric contact-driving gear 20 so that the electric contact-driving gear 20 is intermittently driven to run one revolution in twenty-four hours. A striking stop contact 22 of an electrically conductive and resilient material is fixed to a shaft 20*a* of the electric contact-driving gear. The striking stop contact 22 functions to control the opening-and-closing of a striking circuit 24. Specifically, a printed-circuit board bearing thereon a first stationary contact 28 and a second stationary contact 30 is sandwiched between the electric contact-driving gear 20 and the striking stop contact or rotary contact 22, and the first contact projection 22*a* and the second contact projection 22*b* of the rotaty contact 22 are put into sliding contact relationship with the first stationary contact 28 and the second stationary contact 30 respectively. As shown, the stationary contacts 28 and 30 are printed in the form of concentric rings on the board. As shown, the second stationary contact 30 is in the form of a closed loop, whereas the first stationary contact 28 is in the form of an open loop. In this particular embodiment in one revolution the first contact projection 22*a* travels one fourth of the circumference of the complete circle without being in contact with the first stationary contact 28, and accordingly the striking circuit 24 is kept open for six hours, that is, at night.

As shown, in the striking circuit 24 a striking device 32 and a power supply 34 are series-connected with the stationary contacts 28 and 30, and there is a main switch 36 between the power supply 34 and the first stationary contact 28 and a fifteen-minute switch 38 between the power supply 34 and the striking device 32, thus constituting a part of a Westminster clock. The striking device is so constructed that an associated motor operates a ringing bar. Otherwise, it may include a Read Only Memory in which chime sound or melody is stored. Usually the power supply 34 comprises a battery cell.

The operation of the device for stopping the striking of a time-striking clock at night is described hereinbelow.

When the clock is in operation the intermittent drive gear train which includes the Geneva drive and driven wheels 14 and 16, advances one circumferential pitch within one hour, and the advancement is made between the indicated times of fifty minutes and fifty-five minutes past each hour. Simultaneously the striking stop contact 22 is rotated fifteen degrees for the so-selected five minutes of every hour. Thus, the intermittent drive speed or instantaneous rate of rotation is very high, compared with the drive speed in a conventional device, and it is almost as high as one half of the speed of rotation of the minute hand wheel 12. If the fifteen-degree shift is set at the place where the first contact projection 22*a* of the striking stop contact 22 is just ahead of one end or away from the other end of the first stationary contact 28, the striking can be resumed or stopped at a desired time at night.

Figure 2:
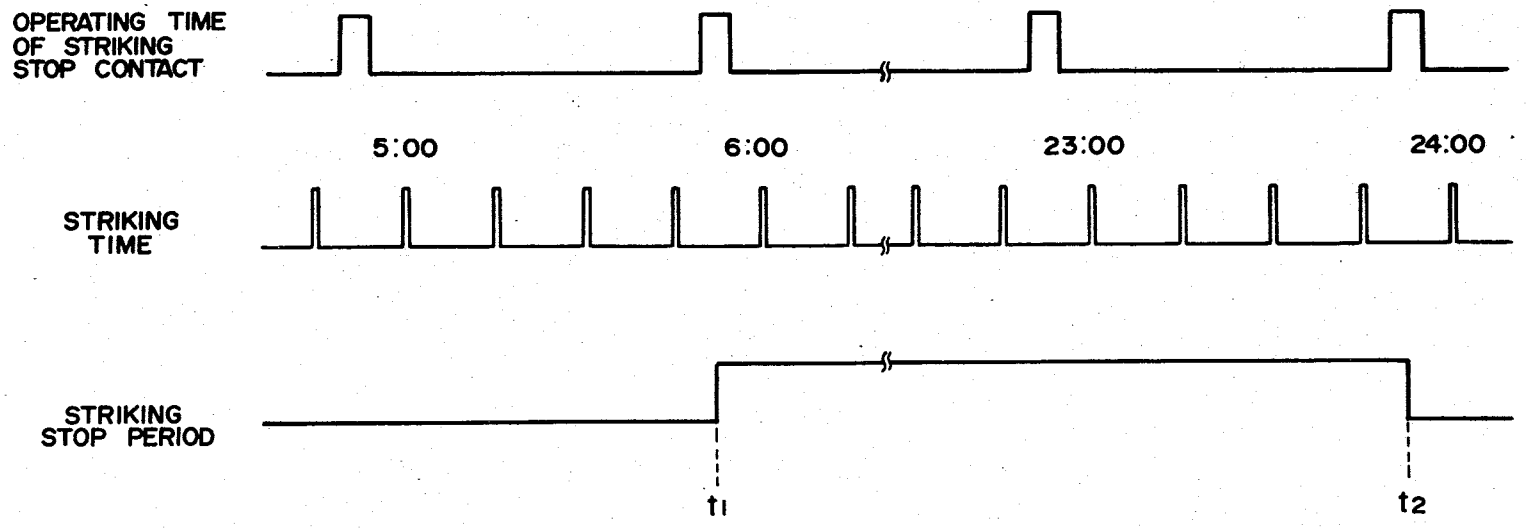
FIG. 2 is a time-chart which shows the operation of a device for stopping the striking of a time-striking clock at night according to this invention.

As for a Westminster clock which chimes every fifteen minutes, as shown in FIG. 2, the striking stop contact 22 is rotated between fifty minutes and fifty-five minutes of every hour, and accordingly the opening or closing of the contact 22 is performed within the five-minute period of advancement, thus assuring the exact control of the opening-and-closing of the striking circuit 24, different from a conventional device for stopping the striking of a time-striking clock at night.

As is apparent from FIG. 2, the sliding shift of the striking stop contact 22 is performed during the opening of a minute control contact which determines at what time (minute) the striking is made in the followership relation with the rotation of the minute hand wheel of the clock gear train. Thus, when the Westminster clock is in the condition of chiming every fifteen minutes, the rotary contact 22 remains stably still on the stationary contacts 28 and 30.

In this particular embodiment a single striking stop contact 22 of an electrically conductive and resilient material is put on two annular and concentric stationary contacts 28 and 30 on a printed-circuit board 26. This arrangement causes the contact projections 22*a* and 22*b* of the striking stop contact 22 to apply an equal force to each of the underlying stationary contacts 28 and 30, thereby providing a reliable conducting path at all times.

A striking device as used may be the one which chimes at selected times, or which produces a melody at selected times.

As is apparent from the above, a device according to this invention is capable of stopping or resuming the striking of a time-striking clock at exactly the desired times in a most reliable way.

As mentioned earlier, the stopping or resumption of the striking of a time-striking clock is performed by bringing the contact projection 22*a* of the striking stop contact 22 apart from one end of the first stationary contact 28 or by bringing the contact projection 22*a* of the striking stop contact 22 onto the other end of the first stationary contact 28. The first stationary contact 28 is made in the form of open loop rather than the closed loop of the second stationary contact 30. When the contact projection 22*a* of the rotary contact 22 traverses from one end to the other end of the open loop, the contact projection 22*a* scratches the surface of a printed-circuit board, which is made of plastics, bakelite or any other insulating material. Thus, minute particles of the insulating material are produced. The minute particles scratched off of the insulating material may happen to come in between the contact projections 22*a* and 22*b* of the rotary contact and the underlying stationary contacts 28 and 30, thus causing a malfunction of non-conduction in the striking stop contact. Recently, clocks have been using MOS integrated circuits and other minute circuit devices, and accordingly a very fine electric current flows through the sliding contact. Therefore, the eventual existence of scratched off particles of insulating material in the sliding contact causes much trouble, that is, obstruction of electric current flow.

Figure 3:
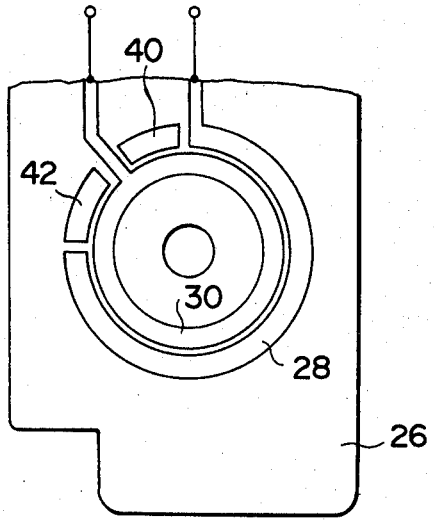
FIG. 3 shows a stationary contact which is different from the one used in the first embodiment of FIG. 1.

Referring to FIG. 3, there is shown another embodiment which is free from the drawback just mentioned. The stationary contacts 28 and 30 on a printed-circuit board 26 are similar to those which appear in FIG. 1 except for provision of two isolated pieces 40 and 42 along the gap in the loop of the first stationary annular contact 28, thereby avoiding the direct contact between the rotary contact projection and the surface of the printed-circuit board. These pieces 40 and 42 are isolated from the first annular stationary contact 28, and are of such a size as to reduce the direct contact between the rotary contact projection and the surface of the printed-circuit board to the minimum possible.

As is apparent from the above, isolated pieces 40 and 42 are provided on the quadrant path along which the rotary contact projection traverses from one end to the other end of the open-loop stationary contact 28, thereby reducing the possibility of the printed-circuit board material 26 being scratched by the rotary contact projection 22*a* to a possible minimum.

Figure 4:
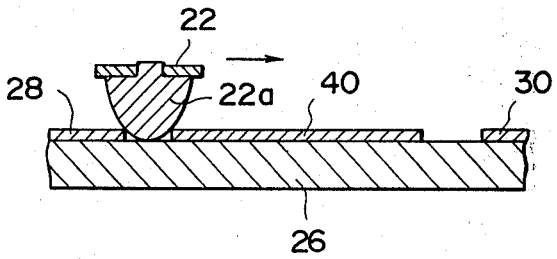
FIG. 4 is a sectional view of the stationary contact of FIG. 3, showing how an associated rotary contact slides on the stationary contact.

FIG. 4 shows the condition in which the contact projection 22*a* has just left one terminal end of the open-looped stationary contact 28. As shown, the contact projection 22*a* is brought onto an insulated piece 40 immediately after leaving one terminal end of the first stationary contact 28, thus causing little or no scratching of the board surface 26 by the rotary contact projection 22*a*. When the rotary contact projection 22*a* is separated from one terminal end of the annular stationary contact 28 and is brought into contact with the isolated piece 42, the rotary slide switch is in the "off" condition as the isolated piece 42 is not connected to any other electrode or conductive part. Then, the gear train drives the rotary contact 22, and the contact projection 22*a* rides into the isolated piece 40, so that the contact projection 22*a* is quite apart from the stationary contact 28, leaving no electrical connection therebetween. Thus, when the contact projection 22*a* is brought into contact with a lead portion of the stationary contact 30, thereby bridging the space between the isolated piece 40 and the lead portion of the stationary contact 30, the stationary contact 30 cannot be electrically connected to the stationary contact 28.

As is apparent from the above, in this particular embodiment, the presence of the isolated pieces in the gap in the open loop stationary contact prevents the contact projection from scratching the printed-circuit board surface which otherwise would be exposed and scratched by the contact projection to produce minute insulating particles. The isolated pieces can be made from the same material as the contacts, and therefore can be electroplated at the same time as a necessary circuit pattern is electroplated on an insulating board.

In this particular embodiment only two isolated pieces are used, but preferably three or more isolated pieces are provided to assure no eventual connection between the stationary contacts.

Specifically, if some of the isolated pieces should be eventually connected to each other with conductive particles filled in the spaces therebetween, the remaining isolated pieces are still in the state of being electrically isolated from each other, thereby preventing the eventual connection of stationary contacts 28 and 30.

Still another embodiment according to this invention makes it easy to detect any breakage in the contact pattern after it has been electroplated on an insulating board. According to this invention a required final pattern to be formed on an insulating board is modified by adding extra pieces to span discontinuities in the required final pattern, and the extra pieces are later broken and removed, thereby leaving the required pattern only.

Figure 5:
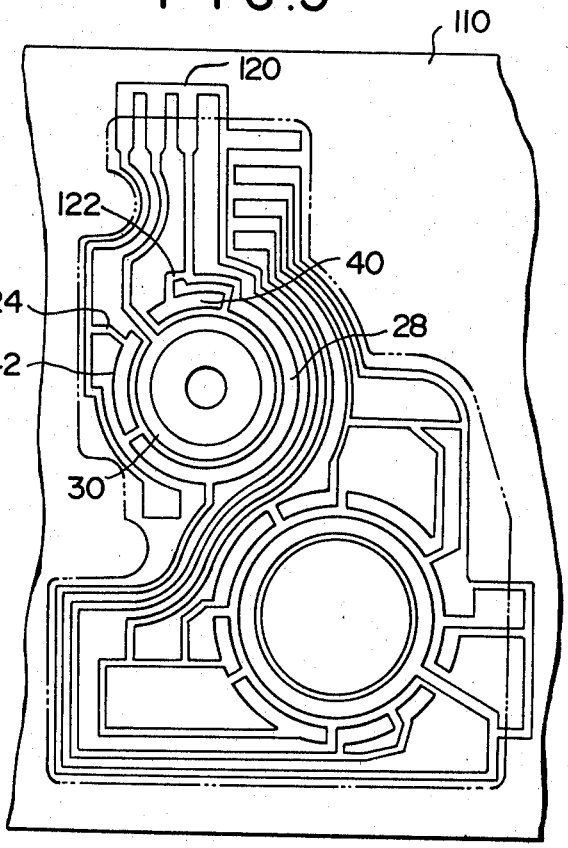
FIG. 5 shows a circuit pattern on a base board, which is used in another embodiment according to this invention.
Figure 6:
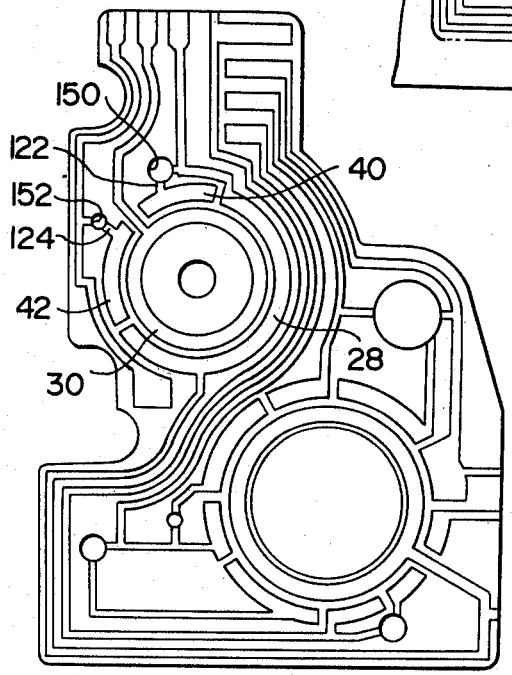
FIG. 6 is a plane view showing a printed-circuit board which has been electroplated, and trimmed with extra and temporary connections removed from the pattern.

Referring to FIGS. 5 and 6, there are shown boards each bearing a contact pattern for stopping the striking of a time-striking clock at night and another contact pattern for the striking.

In FIG. 5, the patterns are formed on a material board 110, and will be later cut out from the material board 110 as indicated by the broken line. The discrete portions 28, 30, 40 and 42 are temporarily and intentionally connected with the aid of extra pieces 120, 122 and 124, thereby forming continuous patterns.

Then, the continuous patterns are subjected to electroplating. If there should be any breakage or discontinuity in the circuit, no electroplating will appear much beyond the breakage or discontinuity. Thus, the non-electroplated part of the circuit beyond the breakage is different in appearance, that is, in colour from the electroplated part of the circuit behind or short of the breakage. Therefore, the breakage in the circuit is easily detected from the discontinuity in colour.

After confirming that the circuit has no breakage or discontinuity, the extra pieces, which are used to make temporary connections between desired discontinuities of the required pattern, are destroyed and removed by making holes 150 and 152 large enough to cut the temporary bridges across the discontinuities of the required pattern. Thus, the complete required circuit pattern is left on the insulating board.

What is claimed is:

1. A device for stopping the striking of a time-striking clock between desired times at night having a striking stop contact means provided in a striking circuit and controlled to open and close in association with a clock gear train, characterized in that a time-striking is made at 15, 30, 45 and 00 minutes which are determined by closing a minute control contact means and said striking stop contact means is slidably engaged with a stationary contact by being rotationally driven by an intermittent drive gear train that is driven by said clock gear train, thereby permitting, in association with a minute gear of the clock gear train, the sliding of said striking stop contact means during the period in which a minute control contact means is opened between 45 minutes and 00 minutes, said period being the time region which is after the finish of time striking is made at predetermined 45 minutes and is before the start of time striking made at the next 00 minutes.

2. A device for stopping the striking of a time-striking clock at night according to claim 1 wherein said striking circuit operates every fifteen minutes.

3. A device for stopping the striking of a time-striking clock according to claim 1 wherein said stationary contact is made in annular form with at least one discontinuity to expose the surface of an underlying insulating board, thereby causing a desired signal while said rotary contact slides on said stationary contact, and the exposed insulating board surface has intermediate metal piece or pieces electrically isolated from each other and at the same time from said stationary contact, thereby reducing the possibility of scratching of the exposed insulating board surface with said rotary contact to a possible minimum.

4. A device for stopping the striking of a time-striking clock according to claim 3 wherein said metal pieces are separated by at least one insulating space, thereby providing a plurality of discrete portions electrically isolated from each other.

5. A device for stopping the striking of a time-striking clock according to claim 3 or 4 wherein said intermediate pieces are printed and electroplated along with said rotary and stationary contacts.

6. A device for stopping the striking of a time-striking clock at night according to claim 3 or 4 wherein said insulating board bears printed patterns which are formed by adding extra pieces to fill all the discontinuities of a required final pattern before electroplating and by making holes large enough to destroy or break said extra pieces after electroplating, thereby leaving the required final patterns on said insulating board.

7. A device for stopping the striking of a time-striking clock at night according to claim 1 wherein said striking circuit is adapted to operate every fifteen minutes.

8. A device for stopping the striking of a time-striking clock at night according to claim 5 wherein said insulating board bears printed patterns which are formed by adding extra pieces to fill all the discontinuities of a required final pattern before electroplating and by making holes large enough to destroy or break said extra pieces after electroplating, thereby leaving the required final patterns on said insulating board.

* * * * *